US005309207A

United States Patent [19]

Omori

[11] Patent Number: 5,309,207

[45] Date of Patent: May 3, 1994

[54] APPARATUS FOR FORMING IMAGE

[75] Inventor: Takashi Omori, Hirakata, Japan

[73] Assignee: Murata Kikai Kabushiki Kaisha, Kyoto, Japan

[21] Appl. No.: 898,283

[22] Filed: Jun. 15, 1992

[30] Foreign Application Priority Data

Jun. 18, 1991 [JP] Japan ..... 3-145897

[51] Int. Cl.[5] ..... G03G 21/00

[52] U.S. Cl. ..... 355/246; 355/208; 355/219; 355/225; 361/225

[58] Field of Search ..... 355/219, 221, 225, 203, 355/204, 208, 214, 246; 361/225

[56] References Cited

U.S. PATENT DOCUMENTS

| | | | |
|---|---|---|---|
| 3,788,739 | 1/1974 | Coriale | 355/210 |
| 4,678,317 | 7/1987 | Grossinger | 355/246 X |
| 4,772,919 | 9/1988 | Yoshiyama et al. | 355/246 X |
| 5,034,772 | 7/1991 | Suzuki | 355/208 |

FOREIGN PATENT DOCUMENTS

| | | |
|---|---|---|
| 0232576 | 11/1985 | Japan . |
| 0252569 | 11/1986 | Japan . |
| 0080278 | 4/1988 | Japan . |
| 0276071 | 11/1988 | Japan . |
| 0012671 | 1/1991 | Japan . |

*Primary Examiner*—A. T. Grimley
*Assistant Examiner*—Matthew S. Smith
*Attorney, Agent, or Firm*—Spensley Horn Jubas & Lubitz

[57] ABSTRACT

The picture image forming apparatus of a type which performs a light exposing on an image holding surface charged at a constant voltage by a charging device having a grid electrode to form an electrostatic latent image and then supplies a toner from a developing device to change the latent image into a visible image, including a voltage division and adjustment circuit for dividing a voltage applied to the grid electrode of the charging device and for adjusting the divided voltage to a predetermined bias voltage for the developing device, a modification and drive circuit for absorbing and modifying a fluctuation of the bias voltage which has been divided and adjusted by the division and adjustment circuit and for driving the division and adjustment circuit, and an operating circuit for operating the drive circuit.

15 Claims, 3 Drawing Sheets

APPARATUS FOR FORMING IMAGE

BACKGROUND OF THE INVENTION

1. Technical Field

The present invention relates to an apparatus for forming an image and, more particularly, to an image forming apparatus of a type which is mounted on an electrophotographic printer and has a predetermined bias voltage-applied developing device.

2. Background Art

FIG. 3 of the accompanying drawings shows a schematic view of a typical image forming apparatus of the above mentioned type. An image formation process of this apparatus will be described below with reference to FIG. 3. As a photosensitive drum 102 rotates in a direction indicated by the arrow K, a main charger 101 charges a surface of the photosensitive drum 102 uniformly. Then, a light is irradiated onto the surface of the charged photosensitive drum 102, in correspondence with an image part, from a light exposure unit 103 which may have an LED array. At this time, the charged electric charge is removed from an exposed part corresponding to the image part (by a photoconduction phenomena) and parts other than the exposed part hold the charged electric charge whereby an electrostatic latent image is formed on the photosensitive drum 102. After that, a toner (a colored fine particle) charged to have the same polarity as the electrostatic latent image is supplied onto the surface of the photosensitive drum 102 to allow the exposed part to electrostatically absorb the toner. Accordingly, the toner image (visible image) is obtained.

Further, a paper P is fed to contact the toner image formed on the photosensitive drum 102 while the electric charge having a polarity opposite the charged electric charge of the toner is being applied onto the back face of the paper by a transferring charger 105. Consequently, an electrostatic force is produced and the toner image on the photosensitive drum 102 is transferred onto the front face of the paper P. Then, the paper P is given heat and pressure by a fixing unit (not shown). As a result, the toner image is fused on the paper P to be a permanent image. On the other hand, after the transferring, the electric charge is removed from the photosensitive drum 102 by a charge removing lamp 106. The toner still remaining on the photosensitive drum 102—some electric charge is not transferred and remains—is removed by a cleaner 107.

A high voltage is applied to the main charger 101, the developing device 104 and the transferring charger 105, respectively. A high voltage source device A applies a high voltage (about −5 KV) to a wire portion 110 of the main charger 101. In the illustration, a scorotron charger having a grid electrode 111 is used as the main charger 101. As compared with a case employing an ordinary charger, the illustrated case can reduce the unevenness of the charge potential (or charging voltage applied) on the surface of the photosensitive drum 102. Generally, about −700 V (bias voltage) is given to the grid electrode Ill to control the charge voltage at the surface of the photosensitive drum 102.

About −300 to −600 V (bias voltage) is given to the developing roller 140 of the developing unit 104 by a second high voltage source device B. The developing roller 140 is a magnet roller having a development sleeve on its surface.

A high voltage (about +5 KV) is given to a wire portion 150 of the transferring charger 105 by a third high voltage source device C.

Incidentally, the high voltage source devices A, B and C are comprised of a number of components, respectively: a DC/DC converter to accept an input from an external DC power source, a voltage raising transducer to raise a voltage of a DC pulse output from the DC/DC converter, a rectifier to rectify the voltage-raised pulse, a controller to control the DC/DC converter, the transducer and the rectifier, and other equipments. Therefore, each of these high voltage devices has a large dimension. Accordingly, the space occupied by these high voltage devices is considerably large. Further, since the high voltage devices have a large number of equipments, the cost ratio of the high voltage devices to the entire image forming apparatus is high.

SUMMARY OF THE INVENTION

The present invention intends to eliminate the above-described problems and its primary object is to provide an image forming apparatus which does not need the high voltage source devices.

Another object of the present invention is to provide a compact image forming apparatus.

Still another object of the present invention is to provide an image forming apparatus which can produce a stable bias voltage in the development process (or stable development bias voltage).

In accordance with a preferred embodiment of the present invention, an image forming apparatus, of a type which performs an optical writing on an image holding surface charged at a constant voltage by a charging device having a grid electrode to form an electrostatic latent image and then supplies a toner from a developing device to change the latent image into a visible image, may include voltage division and adjustment means for dividing a voltage applied to the grid electrode of the charging device and for adjusting the divided voltage to a predetermined bias voltage for the developing device, and development bias voltage applying means having modification and drive means for absorbing a fluctuation of the bias voltage which has been adjusted by the division and adjustment means to modify the bias voltage and for driving the division and adjustment means, and operating means for operating the drive means.

In accordance with the preferred embodiment a predetermined high voltage (bias voltage) is applied to the developing device by the development bias voltage applying means before the toner is supplied to the image holding surface on which the electrostatic latent image has been formed. In such a case, the voltage division and adjustment means divides the voltage applied to the grid electrode of the charging device and adjusts the divided voltage to the predetermined bias voltage suitable for the developing device. The voltage dividing and adjusting means is driven by the drive and modification means, and if the bias voltage thusly adjusted by the voltage dividing and adjusting means changes due to a temperature fluctuation, the drive and modification means stabilizes the bias voltage and modifies the bias voltage to an appropriate value. The modification and drive means may be operated by the operation means in a manner such that the bias voltage is applied to the developing device at a desired timing.

According to the preferred embodiment of the present invention, the high voltage source apparatus used to bias energize the developing unit in the prior art becomes unnecessary for the picture image forming apparatus. In addition, it is possible to bias energize the developing machine by the development bias-voltage apply means which is a compact unit provided on a substrate. Therefore, the cost of the image forming apparatus is remarkably reduced and the apparatus can be designed so as to be compact.

Further, since the development bias-voltage applying means takes advantage of the grid bias voltage of the scorotron charger 1 of which voltage is stable, it is possible to stabilize the bias voltage applied to the developing unit. Moreover, even if the development bias voltage fluctuates due to a temperature fluctuation, for example, the bias voltage is stabilized by the development bias voltage applying means, i.e., the bias voltage is easily modified. Accordingly, a highly stabilized development bias voltage is obtained. Consequently, the development by the developing unit becomes reliable and qualities of the image is considerably improved.

These and other aspects, objects and advantages of the present invention will be more apparent from a following detailed description as read with the accompanying drawings and appended claims.

DETAILED DESCRIPTION OF THE PREFERRED EMBODIMENTS

Now, a preferred embodiment of the present invention will be concretely described with reference to FIGS. 1 and 2 of the accompanying drawings.

Figure 1:
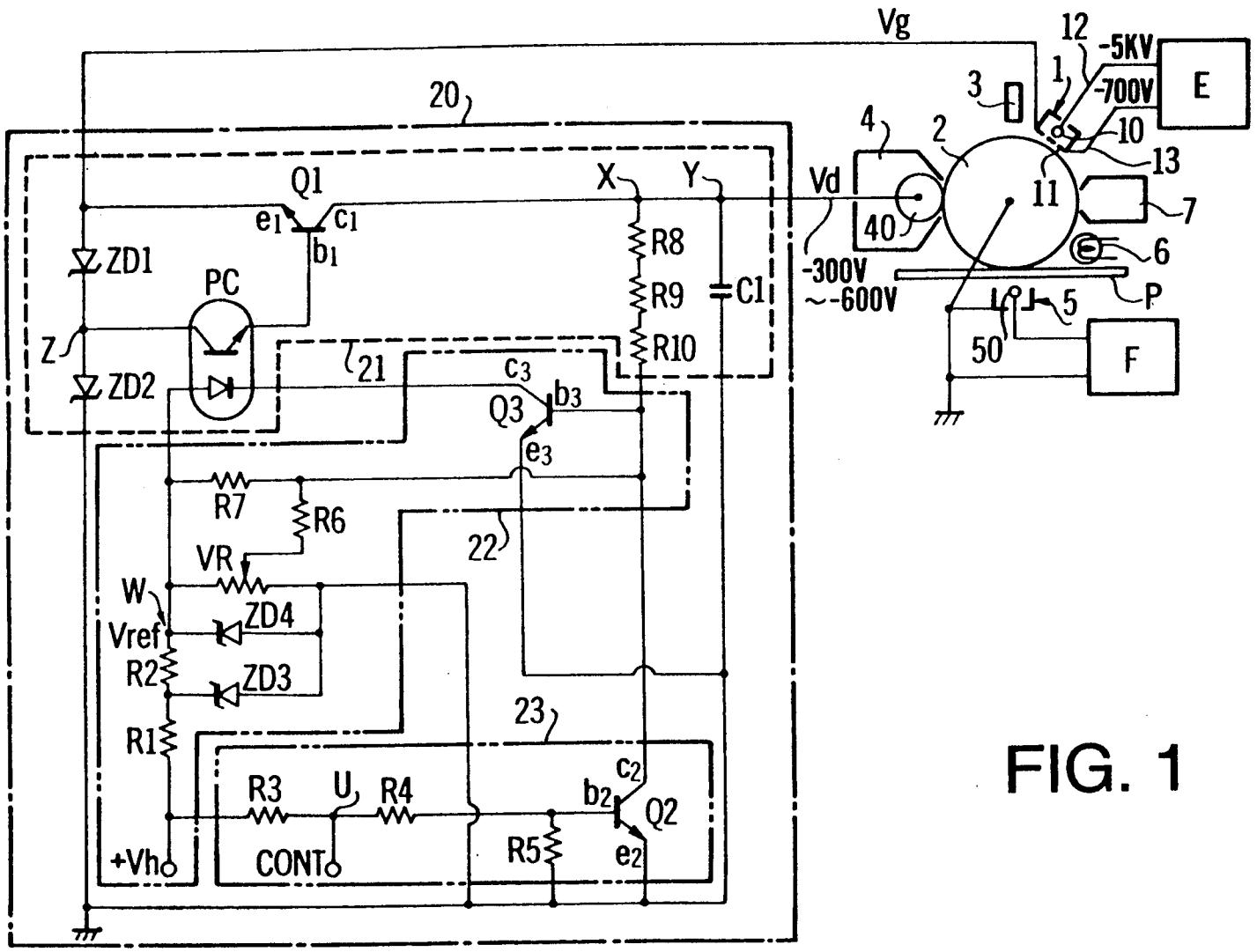
FIG. 1 is a diagram showing major elements of an image forming apparatus according to the present invention.
Figure 3:
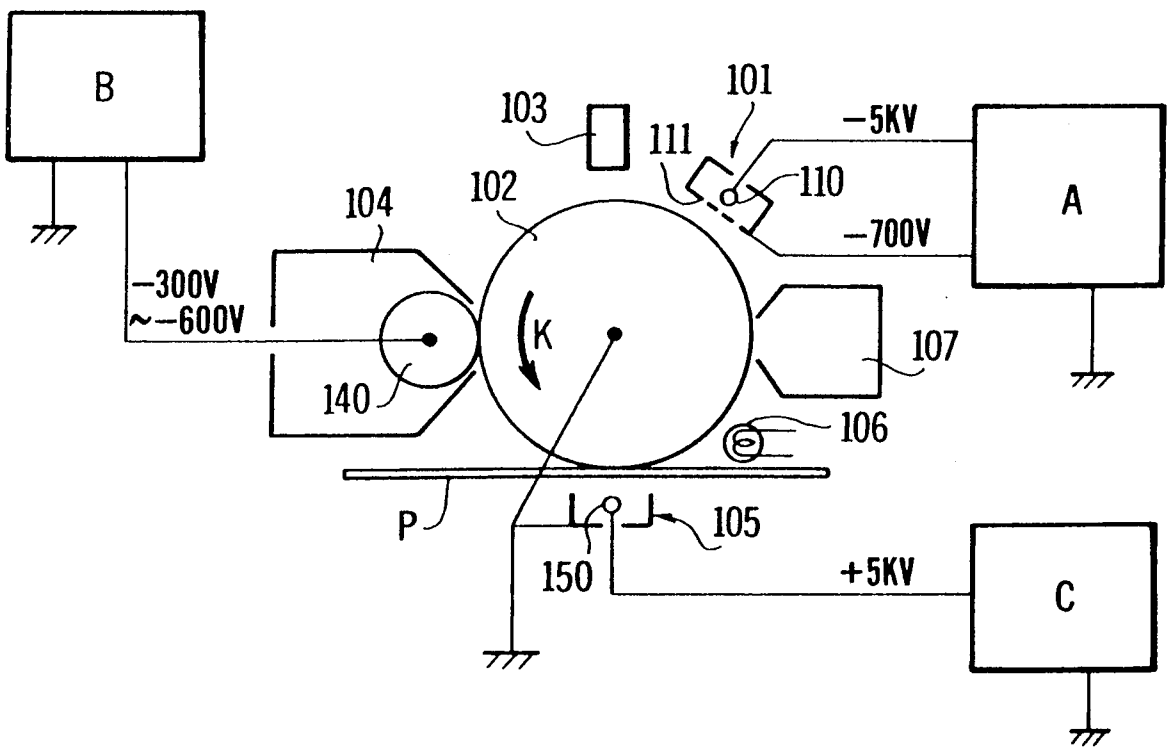
FIG. 3 PRIOR ART
FIG. 3 shows a typical image forming apparatus.

Referring to a block diagram of FIG. 1, illustrated are major components of an image forming apparatus in accordance with a preferred embodiment of the present invention. The fundamental structure of the image forming apparatus of this embodiment is the same as the common example shown in FIG. 3. Specifically, the image forming apparatus includes a photosensitive drum 2, and provided around the photosensitive drum 2 are a scorotron charger 1, a light exposure unit 31 a development unit 4, a transferring charger (a charger for transferring) 5, a charge removing lamp 6 and a cleaner 7. A high voltage (about −5 KV) is applied to a wire portion 10 of the scorotron charger 1 through a lead wire 12. Another high voltage (about −700 V) is applied to a grid electrode 11 of the scorotron charger I through another lead wire 13. A high voltage source device E is provided to supply these high voltages. In addition, another high voltage source device F is connected to the transferring charger 5 to apply a high voltage (about +5 KV) to a wire portion 50 of the transferring charger 5.

On the other hand, a development bias voltage apply circuit 20, which forms an internal circuit as indicated by the single-dot line, is formed on a substrate to apply a bias voltage (about −300 V to about −600 V) to a developing roller 40 of the developing unit 4.

The development bias voltage apply circuit 20 includes a voltage division and adjustment circuit 21, a modification and drive circuit 22 and an operation circuit 23. The voltage division and adjustment circuit 21 divides a grid bias voltage $V_g$ (−700 V) (a voltage applied to the grid electrode 11 of the scorotron charger 1) and then adjusts a development bias voltage. The circuit 21 forms an internal circuit of the circuit 20 as indicated by the broken line. The modification and drive circuit 22 drives the voltage division and adjustment circuit 21 and stabilizes the bias voltage adjusted by the circuit 21 to modify the bias voltage. The circuit 22 forms another internal circuit as indicated by the two-dot line. The operation circuit 23 switch-controls the on/off of the modification and drive circuit 22 with the application timing of the development bias voltage $V_d$. The circuit 23 also forms an internal circuit as indicated by the three-dot line.

The voltage division and adjustment circuit 21 may include constant voltage diodes ZD1, ZD2, a transistor Q1, a photocoupler PC, resistances R8, R9, R10 and a capacitor C1. These circuit elements may be connected as follows: The constant voltage diode ZD1 and an emitter terminal el of the transistor Q1 are both connected to the grid electrode 11 of the scorotron charger 1. The contact point Z of the constant voltage diodes ZD1 and ZD2 and a base terminal b1 of the transistor Q1 are connected to each other via the photocoupler PC. The constant voltage diode ZD2 is connected to the ground. The capacitor C1 is connected to a collector terminal el of the transistor Q1 at the contact point Y. The capacitor C1 is also connected to the in-series-connected resistances R8, R9 and R10 at the contact point X. The resistance R10 is connected with a base terminal b3 of the transistor Q3 in the modification and drive circuit 22. The capacitor C1 is connected with the ground. The collector terminal c1, the contact point X and the contact point Y are respectively connected with the developing roller 40.

With the above described structure, the constant voltage diodes ZD1 and ZD2 stabilize the grid bias voltage $V_g$ and form a stable voltage of the base terminal b1 of the transistor Q1. Specifically, with this voltage division and adjustment circuit 21, it is possible to stabilize the grid bias voltage $V_g$. The photocoupler PC is provided to connect the transistor Q1 with the modification and drive circuit 22. Specifically, the photocoupler PC serves as a switch element to disconnect the circuit 21 and the circuit 22. The circuit 21 forms a high voltage circuit. The voltage divided and adjusted by the transistor Q1, the resistors R8, R9 and R10 and the capacitor C1 is applied, as the bias voltage $V_d$, to the development roller 40. Here, the capacitor C1 is provided as a noise reduction smoothing capacitor of the circuit 20.

The circuit 22 may include the transistor Q3, the resistors R1, R2, R6 and R7, a variable resistor VR and constant voltage diodes ZD3 and ZD4. These circuit elements may be connected as follows: A collector terminal c3 of the transistor Q3 is connected with the photocoupler PC. An emitter terminal e3 of the transistor Q3 is connected with the ground. A base terminal b3 of the transistor Q3 is connected with the resistor R10 and a collector terminal c2 of a transistor Q2 of a switch circuit 23 (will be described later). The base terminal b3 is also connected to the resistors R6 and R7. The resistor R6 is connected with the variable resistor VR. The resistor R7 is connected with the photocoupler PC and the variable resistor VR. The contact point is indicated by the letter "W" in the illustration. The variable resistor VR is parallel connected with the constant voltage diode ZD4. The constant voltage diode ZD4 is connected with the constant voltage diode ZD3 at one end thereof and with the resistor R2 at the other end thereof. The constant voltage diode ZD3 is connected to the resistors R2 and R1 at one end thereof. The variable resistor VR, the constant voltage diodes ZD4 and ZD3 are respectively connected with the ground. One end of the resistor R1 is connected with the resistor R3 of the switch circuit 23 and with a direct current stabilizing power source which is indicated by "+Vh" (for example, a 24 V power source).

With this structure, the voltage supplied from the direct current stabilizing power source +Vh is divided and stabilized by the resistors R1 and R2 and the constant voltage diodes ZD3 and ZD4 to form a voltage $V_{ref}$ at the contact point W. The voltage $V_{ref}$ serves as a reference voltage to operate the modification and drive circuit 22. The voltage $V_{ref}$ is divided by the variable resistor VR and the resistors R6 and R7 and fed to the base terminal b3 of the transistor Q3. Since the transistor Q3 drives the transistor Q1 by way of the photocoupler PC in accordance with the voltage fed to the base terminal b3, it is possible to change the development bias voltage $V_d$ by adjusting the variable resistor VR. Therefore, even if the output voltage of the development bias voltage apply circuit 20 fluctuates due to the change of the load, the development bias voltage $V_d$ can be easily stabilized.

Since the base terminal b3 of the transistor Q3 is connected to the resistor Rio of the voltage division and adjustment circuit 21, the voltage at the point X (the output voltage of the voltage division and adjustment circuit 21) is a voltage which has been divided by the resistors R8, R9 and R10 and the resistors R6, R7 and VR. Accordingly, the fluctuation of the output voltage is fed back to the modification and drive circuit 22 and the transistor Q3 operates the transistor Q1 via the photocoupler PC based on the voltage applied to the base terminal b3 of the transistor Q3. Thus, even if the output voltage of the development bias voltage apply circuit 20 fluctuates due to the temperature fluctuation (The temperature fluctuation at the transistor Q3 is the largest fluctuation.), the modification and drive circuit 22 stabilizes the output voltage and, consequently, it is possible to stabilize the development bias voltage $V_d$.

The operation circuit 23 may include the transistor Q2 and the resistors R3, R4 and R5. These circuit elements may be connected as follows: The collector terminal c2 of the transistor Q2 is connected to the base terminal b3 of the transistor Q3 of the modification and drive circuit 22, and the base terminal b2 of the transistor Q2 is connected to the resistors R4 and R5. The emitter terminal e2 of the transistor Q2 and the resistor R5 are both connected to the ground. A control signal CONT from a CPU (not shown) is input to the contact point U of the resistors R4 and R3. The resistor R3 is connected to the resistor R1 of the circuit 22.

With this structure, the transistor Q2 performs the switching based on the control signal CONT from the CPU and the on/off of the transistor Q3 of the circuit 22 is controlled. The control signal CONT from the CPU carries information about when the development bias voltage $V_d$ should be applied to development roller 40. Concretely, "when" is after the surface of the photosensitive drum 2 is uniformly charged by the scorotron charger 1 and the charged surface is exposed by the light exposure unit 3.

Figure 2:
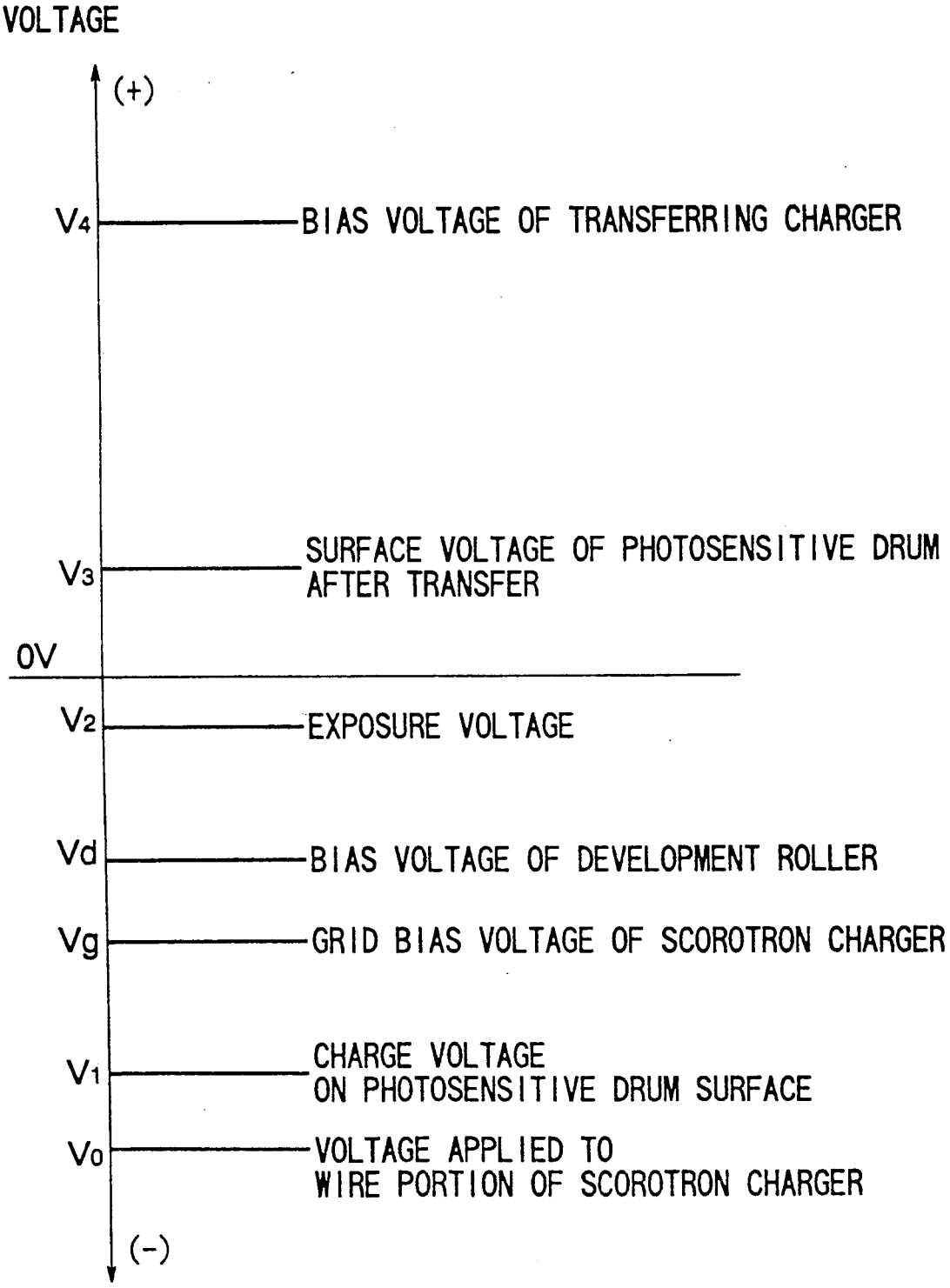
FIG. 2 shows a relative relation between electrical potentials assigned to the respective elements of the image forming apparatus.

FIG. 2 shows a relative comparison of the components of the image forming apparatus in terms of setting voltage. As obvious from the diagram, the electrical potentials of the equipments may be set as follows:

The voltage ($V_0$) applied to the wire portion 10 of the scorotron charger 1 < the charge voltage ($V_1$) on the surface of the photosensitive drum 2 < the grid bias voltage ($V_g$) for the scorotron charger 1 < the bias voltage ($V_d$) for the development roller 40 < the exposure voltage (the surface voltage of the photosensitive drum 2 expose by the light exposure unit 3) ($V_2$) < zero voltage (0 V) < the surface voltage ($V_3$) of the photosensitive drum 2 after the transferring < the bias voltage ($V_4$) for the transferring charger.

In this diagram, the $V_g$ is about −700 V and the $V_d$ is about −300 V to about −600 V. Thus, the difference between theses two setting voltages is small. Accordingly, it is advantageous in terms of energy to bias energize the development roller 40 by the development bias voltage apply circuit 20 (FIG. 1) using the stable grid bias voltage $V_g$ of the scorotron charger 1.

We claim:

1. An image forming apparatus, comprising:

charging means, including a grid electrode, for forming an electrostatic latent image on an image holding surface charged at a constant electrical potential, developing means for supplying toner to the image holding surface, voltage division and adjustment means for dividing a grid bias voltage applied to the grid electrode, for adjusting the divided grid bias voltage to produce an output voltage corresponding to predetermined developing bias voltage, and for applying the output voltage to the developing means;

modification and drive means for stabilizing the output voltage and for driving the voltage division and adjustment means; and operation means for controlling times at which the modification and drive means drives voltages division and adjustment means.

2. The image forming apparatus of claim 1, wherein the voltage division and adjustment means includes a first constant voltage diode, a second constant voltage diode, a transistor, a photocoupler, a first resistor, a second resistor, a third resistor and a capacitor, and the first constant voltage diode and an emitter of the transistor are connected to the grid electrode of the charging device, the first and second constant voltage diodes are connected in series, a first contact point of the first and second constant voltage diodes is connected to a base of the transistor via the photocoupler, the second constant voltage diode is connected to a ground, the first, second and third resistors are connected in series, a collector of the transistor is connected to the first resistor at a second contact point, one end of the capacitor is connected to the collector of the first transistor at a third contact point and the other end of the capacitor is connected to the ground, the third resistor is connected to the modification and drive means, the developing means includes a development roller, and the second and third contact points are connected to the development roller.

3. The image forming apparatus of claim 2, wherein the photocoupler connects the first transistor with the modification and drive means such that the photocoupler serves as a switch element for connecting and disconnecting the voltage division and adjustment means and the modification and drive means from one another.

4. The image forming apparatus of claim 3, wherein the capacitor comprises a noise reduction smoothing capacitor.

5. The image forming apparatus of claim 1, wherein the charging means includes a scorotron charger.

6. The image forming apparatus of claim 1, wherein the charging means includes a wire portion, the apparatus further comprising:

a first high voltage source device for supplying a first high voltage to the wire portion of the charging device and a second high voltage to the grid electrode of the charging device.

7. The image forming apparatus of claim 6, wherein the first high voltage is equal to approximately −5 KV, and the second high voltage is equal to approximately −700 V.

8. The image forming apparatus of claim 6, further comprising:

a second high voltage source device, and a transferring charger including a wire portion, wherein the second high voltage source device is connected to the transferring charger to apply a third high voltage to the wire portion of the transferring charger.

9. The image forming apparatus of claim 8, wherein the third high voltage is equal to approximately +5 KV.

10. The image forming apparatus of claim 8, wherein the operation means includes an operation circuit for switch-controlling an on/off of the modification and drive means corresponding to an application timing of the developing bias voltage.

11. The image forming apparatus of claim 6, wherein a voltage applied to the wire portion of the charging means is substantially less than a charge voltage on the image holding surface, the charge voltage on the image holding surface is substantially less than the grid bias voltage applied to the grid electrode, the grid bias voltage applied to the grid electrode is substantially less than the predetermined developing bias voltage, the predetermined developing bias voltage is substantially less than a first surface voltage of the image holding surface exposed by a light exposure unit, the first surface voltage of the image holding surface is substantially less than zero V, a second surface voltage of the image holding surface is substantially greater than zero V after transfer, and the second surface voltage is substantially less than a transferring charger bias voltage.

12. The image forming apparatus of claim 1, wherein the predetermined developing bias voltage is between approximately −300 V and approximately −600 V.

13. The image forming apparatus of claim 1, wherein the modification and drive means includes a transistor, a first resistor, a second resistor, a third resistor, a fourth resistor, a variable resistor, a first constant voltage diode and a second constant voltage diode, the voltage division and adjustment means includes a photocoupler and a fifth resistor, and a collector of the transistor is connected with the photocoupler, an emitter of the transistor is connected with a ground, a base of the transistor is connected with the fifth resistor, the operation means, and the third and fourth resistors, the third resistor is connected with the variable resistor, the fourth resistor is connected with the photocoupler and the variable resistor, the variable resistor is connected in parallel with the second constant voltage diode, the second constant voltage diode is connected with the first constant voltage diode at one end thereof and with the second resistor at the other end thereof, the first constant voltage diode is connected to the first and second resistors, and the variable resistor, the first and second constant voltage diodes are respectively connected with the ground, and one end of the first resistor is connected with the operation means and with a direct current stabilizing power source.

14. The image forming apparatus of claim 13, wherein the direct current stabilizing power source comprises a 24 V power source.

15. The image forming apparatus of claim 1, wherein modification and drive means includes a first transistor and a first resistor, the operation mans includes a second transistor, a second resistor, a third resistor and a fourth resistor, and a collector of the second transistor is connected to a base of the first transistor, a base of the second transistor is connected to the third and fourth resistors, an emitter of the second transistor and the fourth resistor are both connected to a ground, and the second resistor is connected to the first resistor.

* * * * *